United States Patent [19]

Graat et al.

[11] 4,334,854

[45] Jun. 15, 1982

[54] METHOD OF CONTROLLING THE COMBUSTION OF LIQUID FUEL

[75] Inventors: Johannes W. Graat, Overasselt; Hans J. Remie, Nijmegen, both of Netherlands

[73] Assignee: Smit Ovens Nijmegen B.V., Nijmegen, Netherlands

[21] Appl. No.: 917,539

[22] Filed: Jun. 21, 1978

[30] Foreign Application Priority Data

Jun. 29, 1977 [DE] Fed. Rep. of Germany ..... 2729321

[51] Int. Cl.[3] ..... F23C 5/00; F23C 5/06

[52] U.S. Cl. ..... 431/8; 431/186; 431/189; 239/407; 239/420

[58] Field of Search ..... 431/8, 189, 186; 239/401, 407, 420

[56] References Cited

U.S. PATENT DOCUMENTS

| | | | |
|---|---|---|---|
| 657,579 | 9/1900 | White | 431/186 X |
| 1,175,629 | 3/1916 | Gerwig | 431/186 |
| 1,202,425 | 10/1916 | Randall | 137/604 |
| 1,943,750 | 1/1934 | Tryon | 431/186 X |
| 2,242,787 | 5/1941 | Lieberherr | 431/186 X |
| 3,349,826 | 10/1967 | Poole et al. | 431/186 X |
| 3,748,100 | 7/1973 | Forseth | 431/186 X |
| 3,788,797 | 1/1974 | Mayfield et al. | 431/186 |
| 3,852,022 | 12/1974 | Medeot et al. | 431/186 |
| 4,084,934 | 4/1978 | Kumazawa | 431/189 |
| 4,144,016 | 3/1979 | Takahashi et al. | 431/8 |

FOREIGN PATENT DOCUMENTS

| | | | |
|---|---|---|---|
| 2250068 | 5/1975 | France | 431/186 |
| 832197 | 4/1960 | United Kingdom | 239/420 |

*Primary Examiner*—Samuel Scott
*Assistant Examiner*—Randall L. Green
*Attorney, Agent, or Firm*—Fitch, Even, Tabin, Flannery & Welsh

[57] ABSTRACT

The present invention relates to a method of controlling a substantially stoichiometric combustion of liquid fuels in a burner assembly wherein a stream of compact or atomized fuel is produced by means of an orifice or nozzle (e.g. injection, pressure, rotary atomizing nozzle) and fed into a mixing and atomizing zone in accordance with the preferably adjustable, nozzle input pressure, wherein at least part of the combustion air as an atomizing medium is introduced from the side of the axis of the fuel stream, with the flow of such air being adapted to be controlled with respect to throughput (flow rate) and flow velocity, and including a subsequent combustion of the fuel/air mixture within a combustion zone downstream of said mixing zone.

2 Claims, 9 Drawing Figures

METHOD OF CONTROLLING THE COMBUSTION OF LIQUID FUEL

The expression "stoichiometric combustion" relates to such combustion which is accompanied neither by soot (measured according to BACHARACH: Soot number "zero"), nor by any noticeable oxygen content of the combustion gases (oxygen content in the range of from 0.01 to 0.1%). The control may be applied also to an understoichiometric combustion for generating a reducing atmosphere including relative high CO contents (5 to 6%) without the formation of soot. The term "liquid fuels" relates particularly to fuel oils. These may be fuel oil of classes EL, L or S (extra light, light or heavy). The respective viscosity values of such fuels are determined by e.g. German Industrial Standards. The viscosity of oils is greatly reduced when the oils are heated, such that, under certain circumstances, a heavy fuel oil may be converted by heating into an oil showing the viscosity characteristics of a medium fuel oil. Waste oils, slurry-type fuels and the like are also useful for the combustion.

The abovementioned combustion method operating with dual-stage atomization is performed, for instance, with a burner of the type according to U.S. Pat. No. 3,870,456. In this burner and other burners which are operated with the abovementioned liquid fuels, it is essential that the energy-containing liquid is fed into the combustion zone in as finely as possible a divided form, such that the liquid is more readily gasified or vaporized. In such case, the stoichiometric combustion of low viscosity fuels in general provides a so-called blue flame which indicates that substantially no carbon excess is present. Normally, blue flames require that the size of the droplets in the atomization of the fuel is reduced to below a predetermined value, depending on the type of fuel. However, the flame spectrum also may be shifted toward the yellow side under stoichiometric combustion, when high-viscosity, high-ash or lightly contaminated fuels are burnt.

In the first stage of the combustion, mechanical atomizing nozzles may be used; such nozzles are known in various constructions. In such case, the droplet size formed upon the exit from the nozzle is defined by the following parameters:

(a) Atomizing characteristic of the nozzle;

(b) viscosity of the fuel;

(c) surface tension of the fuel;

(d) pressure (p) existing at the nozzle inlet; or (e) rate of fuel flow (throughput) being fixedly related to the pressure.

In the distribution of droplet sizes obtained in the pressure atomization, a so-called mean droplet diameter according to SAUTER may be defined by stating that the mean droplet diameter has the same specific surface area that corresponds to the diameter of the droplet.

(SMD=Sauter Mean Diameter):

$$SMD = \frac{52\, M^{0,282}\, \nu^{0,204}}{p^{0,397}}\ (\mu m) \qquad (1)$$

wherein

M=Flow number of the atomizer ($Q/\sqrt{p}$)

Q=throughput (kg/h)

$\nu$=kinematic viscosity of the fuel (cSt)

p=atomizing pressure (kg/cm$^2$)

(compare HANSEN: "Ölfeuerungen"; Springer-Verlag, Berlin 1970, page 67).

In fact, during the atomization various droplet sizes occur in accordance with a distribution function. Characteristic droplet sizes, with identical inlet pressures, are 60 μm in the case of injection atomizers; 100 μm with pressure (mechanical) atomizing nozzles; 250 μm with rotary atomizing nozzles, according to KÄMPER (periodical "Öl-und Gasfeuerung"; 1972; page 490).

In a two-stage atomizer upon which the method according to the invention is based, the stream of fuel which enters the mixing chamber without disturbance e.g. in the form of an oil vapor having a conical shape of three-dimensional expansion, is acted upon by an atomizing medium laterally of the axis. This medium is constituted by the whole combustion air or part thereof; preferably, the entirety of the combustion air is used to this end. In this case, the gaseous medium is added with a relative velocity to the droplets flowing substantially in the direction of the axis. The energy or momentum transmitted to the flying oil droplets from the atomizing medium is therefore dependent on the relative speed between the oil droplets and the atomizing medium. In view of the fact that, on the average, it may be assumed that all oil droplets flow in the direction of the axis, obviously the relative speed with respect to such axial direction is the reference value when interaction between the atomizing medium and the oil droplets is to be estimated quantitatively. In this consideration the fact may be neglected that the oil droplets, even with no atomizing medium present, are not only atomized at the atomizing nozzle, but also disintegrated while flowing ("flying") through the "stationary" atmosphere of the mixing chamber. At any rate, the velocity of the droplets upon separation from the nozzle is between 40 and 60 m/sec. (Kämper, loc. sit.).

The moving droplets are influenced by the atomizing medium. Hereby, the droplet surface is subjected to deforming forces which are counteracted by the internal cohesion forces of the liquid. If the surface tension induced thereby is smaller than the external pressure, the droplet is deformed until it is divided (broken up). The reduction of size results in increase of the surface tension. The newly formed droplets assume a spherical shape; if sufficient energy is applied, further division may take place.

In principle, a range from coarse to fine atomizations of the liquid fuels may be obtained with any nozzle atomizing system by variation of the inlet pressure. However, a primary atomization which is supposed to produce extremely small droplets, requires high energy to press the fuel into the nozzle. Therefore, it is more economical to provide for a secondary atomization for further vaporizing.

However, the secondary atomization has heretofore been considered only under the aspect of obtaining a reduction of size of the droplets by about one order of magnitude. In the burner mentioned at the beginning, this could be effected, by using fuel oil of the class EL, by means of a primary atomization of the droplets to form droplets of about 50 μm. Under optimum conditions of adjustment of the secondary atomization, the droplet size could be reduced to an average as small as 5 μm. However, this requires that the atomizing medium is urged through the lateral atomizing nozzles under critical pressure, i.e. at specific sound velocity. This high pressure necessitates relatively expensive blowers and a high amount of energy which are contrary to the economy of the conventional combustion method.

In the aspired stoichiometric combustion which, with the use of the conventional burner, could be effected even within varying ranges of load, the oxygen content and the soot number could be reduced to such a minimum as has been unknown before that time in commercially available burners. The same results are to be obtained also by applying the novel combustion method, while the efficiency should be increased and the range of control is to be extended.

Accordingly, it is the object of the invention to provide a method of controlling a preferably stoichiometric (or optionally understoichiometric) combustion, wherein the oil vapor to be burnt under varying conditions of operation is given such a mean droplet diameter that a carbon-free or soot-free and substantially oxygen-free or reducing combustion gas is produced.

This object is solved in that the pressure of the fuel at the inlet of said fuel nozzle and the mean relative velocity of the combustion air introduced as said atomizing medium with respect to the compact or atomized fuel passed in a stream are adapted to be adjusted in inversely proportional relation to each other.

Preferably, the full volume of combustion air is utilized as atomizing medium in order to take the greatest possible advantage of the energy content thereof. In this way, it is obtained that a relatively low air pressure only need be maintained for the introduction combustion air. Another important advantage may be seen in the fact that the fuel particles are absolutely homogeneously admixed with the air, whereby an extremely short burning-out period is obtained.

As can be clearly seen from the above equation (1) for the SMD (Sauter Mean Diameter), the droplet size depends on the input pressure or flow rate, respectively. However, the regulation of the heat output necessitates that fuel is injected with higher or lower flow rates, whereby the control is effected via the oil pressure or the variation of the conduit cross-section. In these respects, it has heretofore been considered as inevitable that stoichiometric combustion was impossible to be achieved when the pressure falls below a given value, since the atomizing medium supplied resulted in an excess of air. For this reason, the conventional two-stage burners were operated substantially under full load only.

Now, the method according to the invention permits a combustion under stoichiometric conditions over wide ranges of loads. In this method, it is surprising that stoichiometric combustion can be obtained particularly in the lower load range and even with a continous stream of compact fuel.

The method according to the invention is based upon the idea that the initial droplet size must be reduced, and that the energy required to this effect should be furnished by the atomizing medium supplied in the second stage. However, in view of the fact that the ratio between the quantities or volumes of fuel and air supplied is subject to exact proportionality in the case of a stoichiometric combustion, the invention was required to solve the object of reducing the droplet diameter by taking into consideration such proportionality.

In general, the mean droplet diameter (SMD) to be measured during the outflow from the nozzle is in the range of between 50 and 200 μm, and the relative velocity v of the air flow with respect to the axis of the fuel stream is between 40 and 250 m/sec. In this connection, this velocity has not been measured directly, but rather derived from the below equation (2) on the basis of measurements of the dimensions Q and A:

$$v = Q/A \tag{2}$$

wherein v = velocity;

Q = volume of air per unit of time; and

A = cross-sectional area.

These velocity values permit the droplet diameter to be reduced to a size of less than 10 μm so as to produce a "blue flame" at stoichiometric combustion. As indicated at the beginning, stoichiometric combustion is not only present with a blue flame, but also with flames having yellow color portions, especially when burning highly viscous or high-ash fuels.

The present method even allows to break up by means of the atomizing air a compact fuel stream (theoretically infinite droplet size) to such degree that a combustion within the combustion zone takes place which complies with the abovementioned conditions. In accordance with the above definition, the velocity is of the order of v = 180 to 250 m/sec.

According to the invention, it is further proposed to control the rate of flow of the combustion air by varying the area of the inlet cross-section for the air into the mixing chamber. In such case, on the one hand, the air pressure for supplying the combustion air may be relatively low such that blowers or fans of simple construction may be used. On the other hand, an oil supply control valve may be mechanically coupled to a mechanism for varying the intake area. The air pressure may be surprisingly low, and at any rate by far below the critical pressure, e.g. of the order of 0.1 bar (atmospheres). It is hereby feasible to equalize the relative flow velocity across the entire circumference of the combustion chamber; this means that the supply of air to the mixing zone is effected in axially symmetrical distribution and around the axis of the fuel stream.

For carrying out the above method, the invention proposes a burner assembly comprising an atomizing nozzle or inlet orifice having arranged subsequently thereto (downstream thereof) a passage surrounded by a shell and forming a mixture zone, with the fuel stream being injected into said passage, and comprising at least one aperture provided in said shell, through which the combustion air may be supplied laterally of said stream into said passage. According to the invention, said aperture or apertures for the supply of the combustion air acting as atomizing medium are spaced in downstream direction from the opening of said atomizing (spray) nozzle and adapted to be varied in their cross-sectional area. It has been found that this assembly can be incorporated into a control loop in relatively easy manner.

Preferably, discrete bores or slots distributed around the circumference and across the length of said shell are provided as said apertures, with from three to twenty, preferably twelve, bores or slots being spaced around the circumference of said shell in axially symmetrical arrangement.

The mixing zone and passage, respectively, may be designed in a manner that the cross-sectional area is constant throughout from the mouth of the fuel nozzle up to the transition into the combustion zone. Preferably, the passage is formed as a cylinder in this case.

In mechanical respects, the variation of the air supply or intake cross-sectional area may be realized in an easy manner in that the shell enclosing the passage is connected to an air intake duct at the side remote from the mixing zone, and that the cross-sectional area of the apertures formed in the shell is adapted to be adjusted by means of control devices provided on the outer side of the shell. In particular, a sliding sleeve may be attached to the inner face of the shell, which sleeve acts to cover one or more apertures by varying the flow cross-section. Advantageously, this sliding sleeve may be operated from the exterior side.

Still further, it is possible that a lance provided with said nozzle at the tip thereof is mounted for axial movement along the burner axis, and that the front portion of said lance is adapted to be inserted into said mixing zone as a sliding sleeve. As indicated, a single aperture may serve as intake for the atomizing air. However, it is also—and preferably—possible to provide discrete bores or slots as apertures spaced over the circumference and length of the shell.

As a modification of the above-indicated embodiment, it may be advisable in consideration of specific conditions of operation that the passage in the axial direction, as seen from the combustion zone, initially defines a cylindrical chamber of smaller diameter, and then a chamber of greater diameter, and that apertures open in the walls of both chambers. In this latter embodiment, the smaller chamber may be disposed directly within the lance.

Other embodiments as disclosed in the subclaims are explained below by referring to the drawings.

Special reference may be made to the possibility of controlling the burner assembly in such a way that the mechanism for the control of the air intake cross-sectional area is coupled with a device (valve) acting to adjust the intake volume of the fuel.

Finally, it is possible to modify the burner assembly in a way that it may be used also for the burning of fuel or heating gas. To this end, the invention proposes that a further passage opens into said mixing zone while bypassing said atomizing nozzle, said passage being connected to a gas intake and the cross-sectional area of said passage being dimensioned for receiving gases to be burnt.

The method according to the invention as well as various embodiments of the present apparatus are explained below in greater detail by referring to the drawings, wherein.

Figure 3:
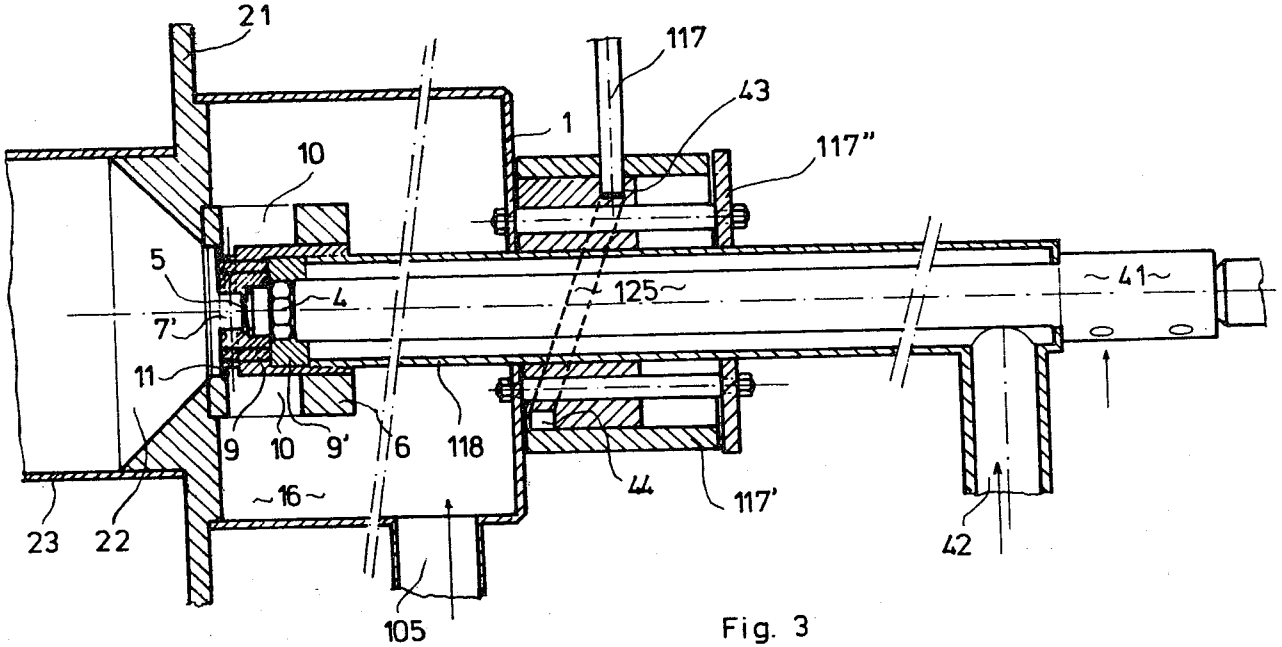
FIG. 3 shows a burner according to a first embodiment.
Figure 4A:
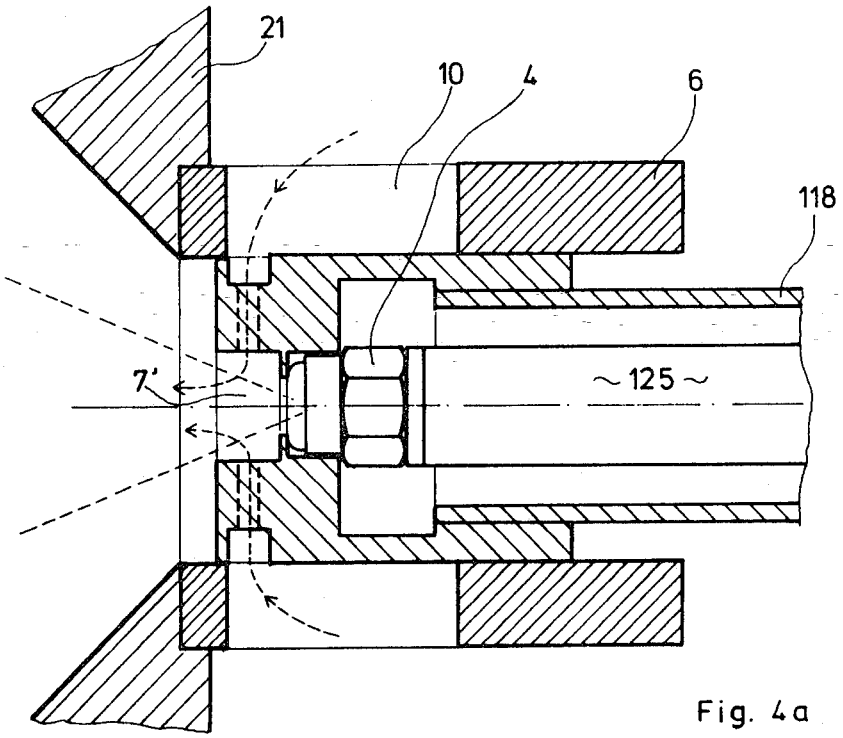
Figure 4B:
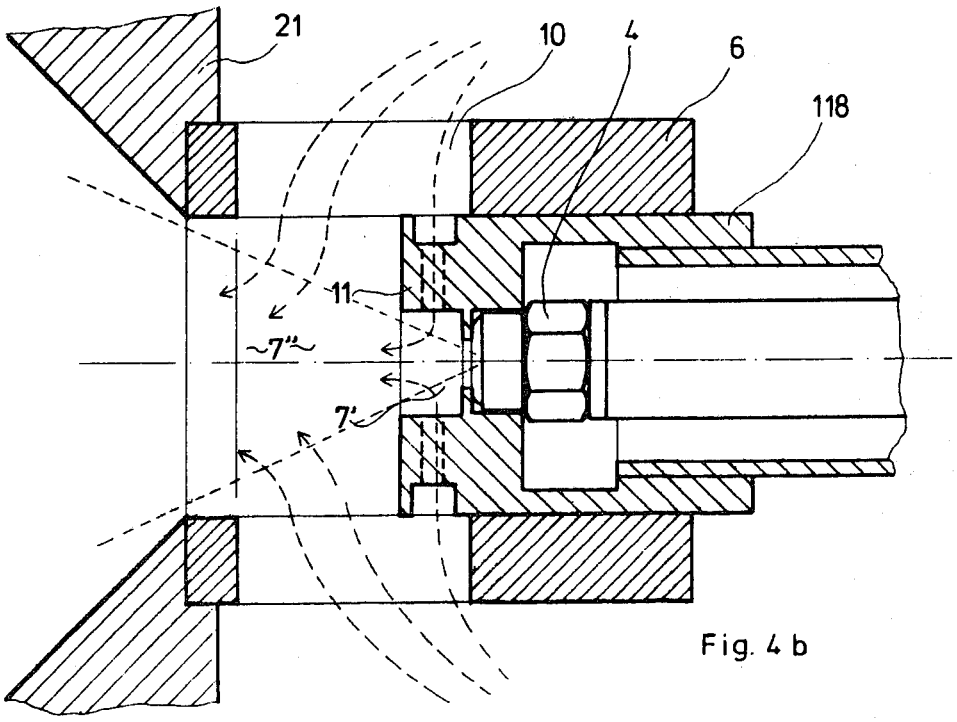
Figure 5:
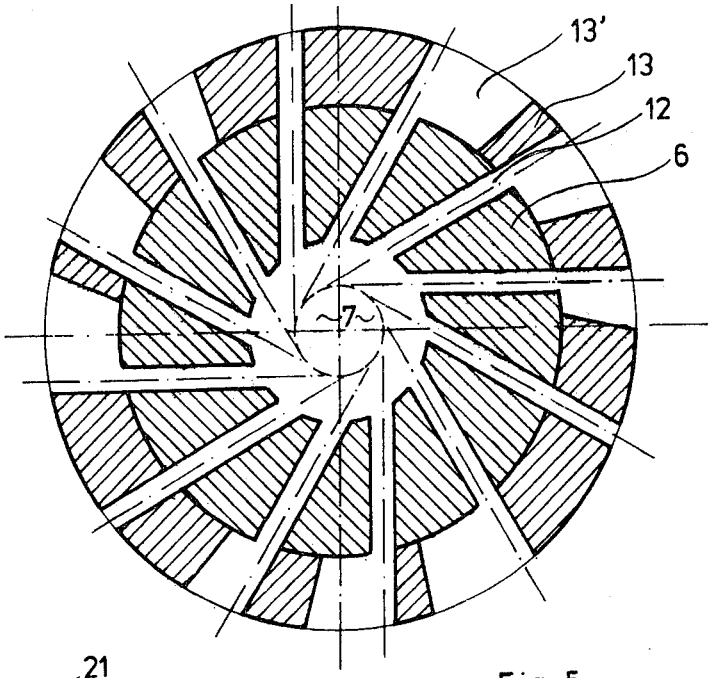
Figure 6:
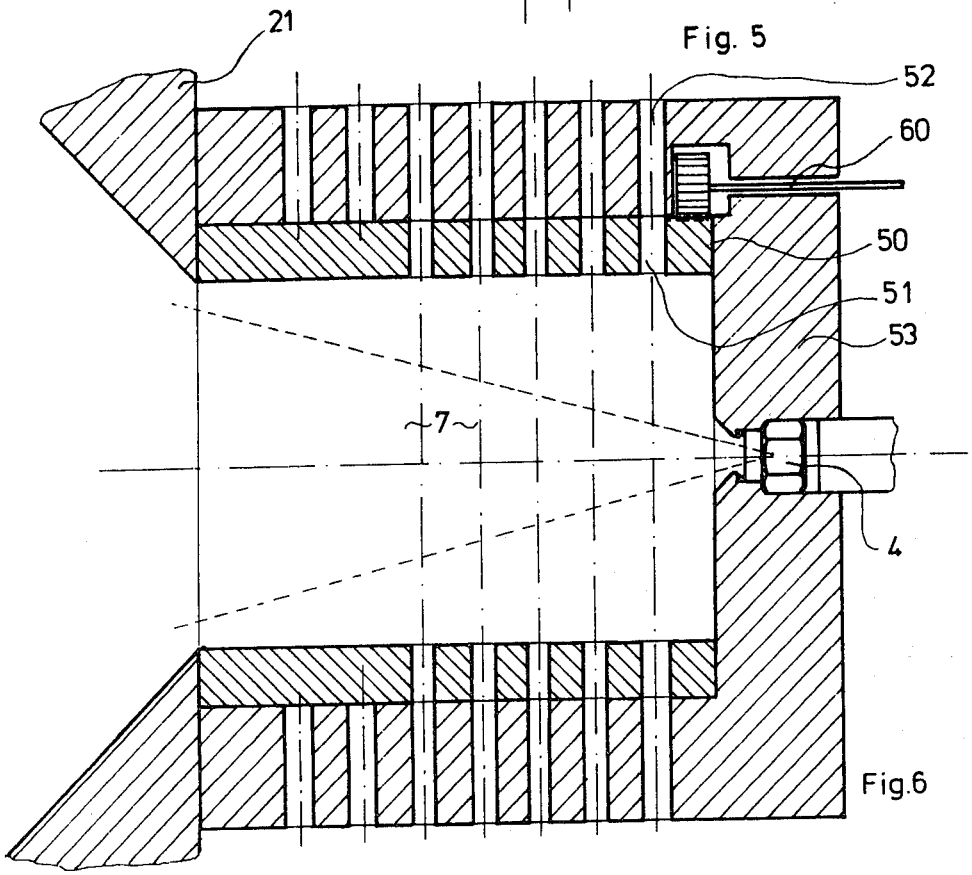
Figure 10:
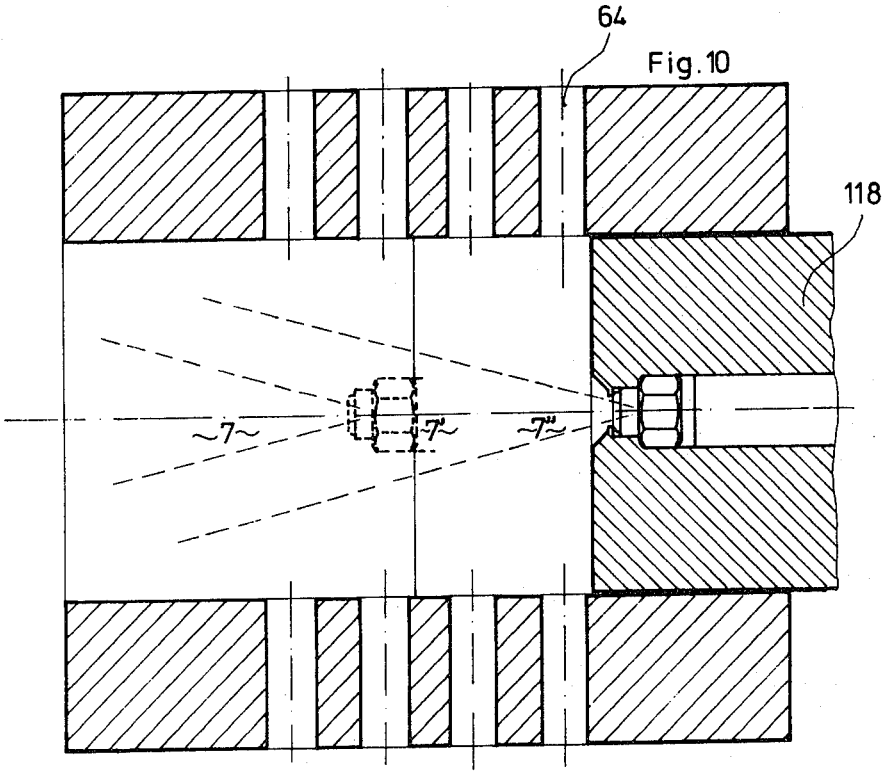
Figure 11A:
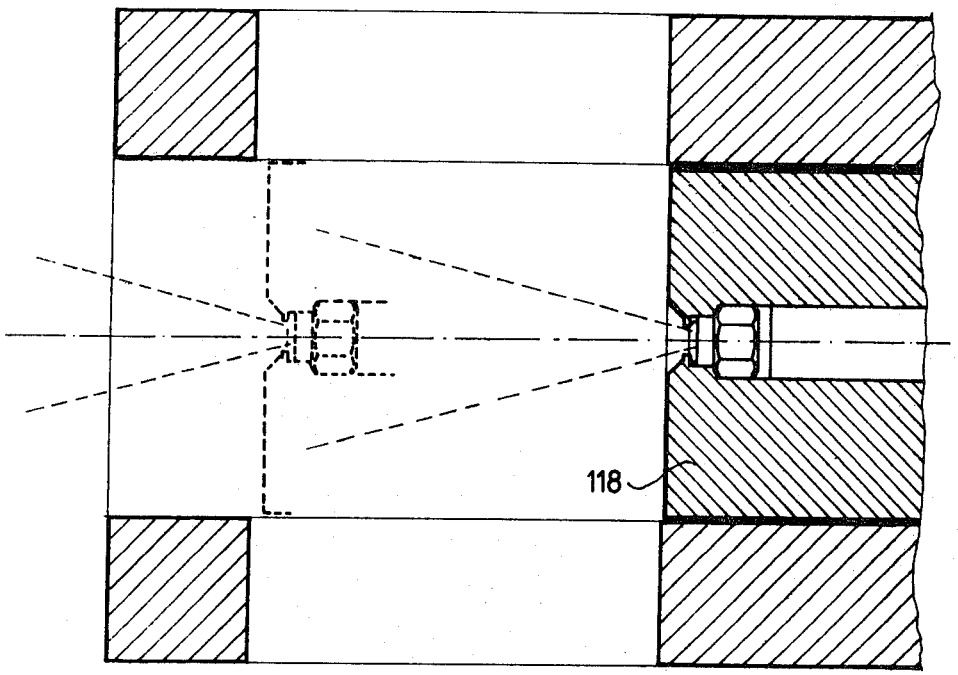
Figure 11B:
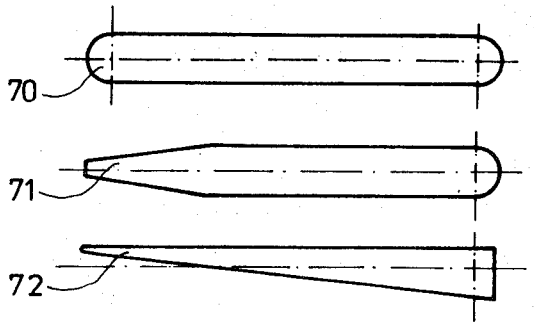
Figure 12:
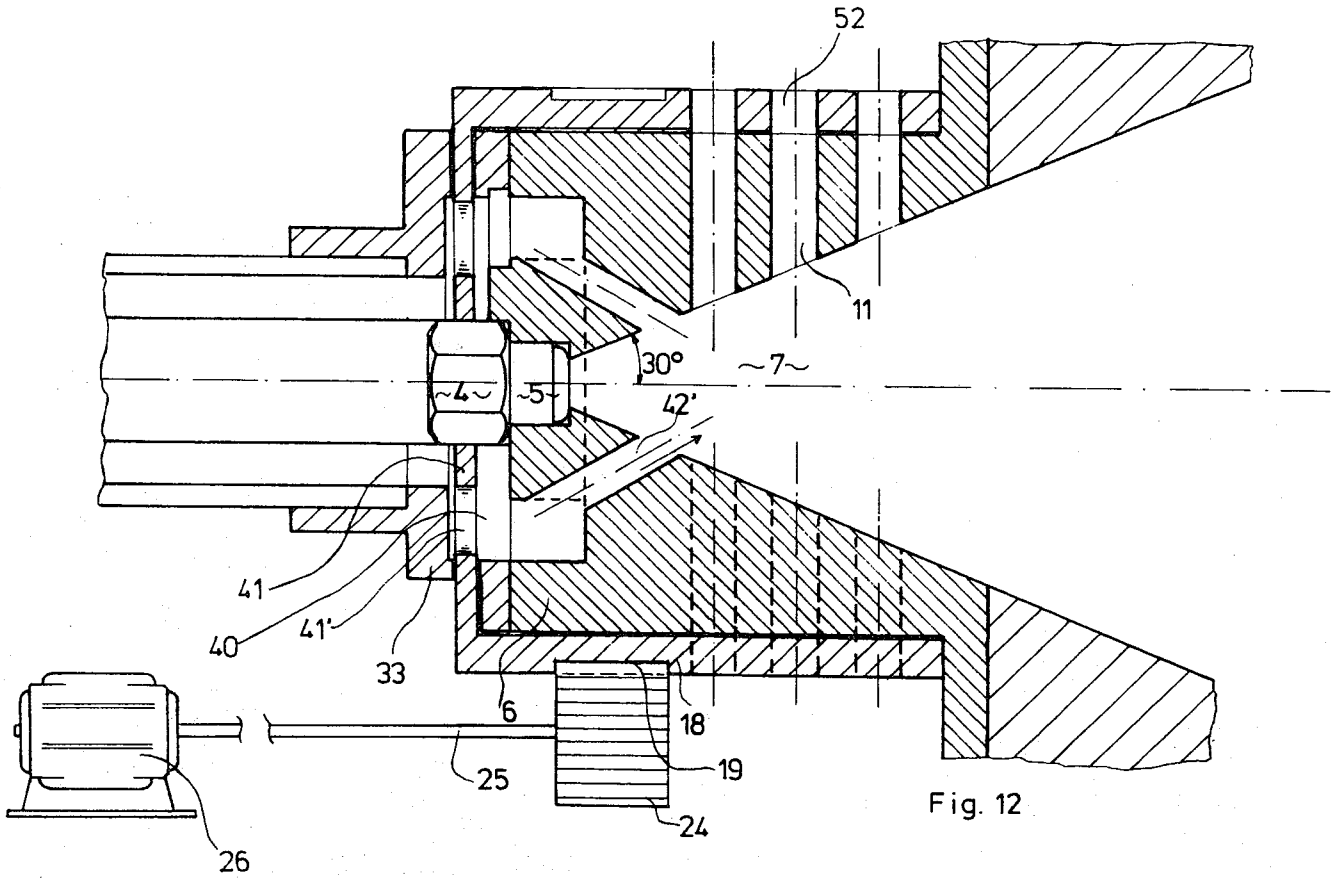

FIGS. 4*a* and 4*b* show the positions of the fuel control system of the embodiment according to FIG. 3;

FIG. 5 is a cross-sectional view of the mixing chamber passage including the intake openings and control means;

FIG. 6 is an axial sectional view showing another control means;

FIGS. 7 to 11*b* are axial sectional views illustrating other methods of control; and FIG. 12 shows another embodiment of a dual mode fuel burner.

Figure 1:
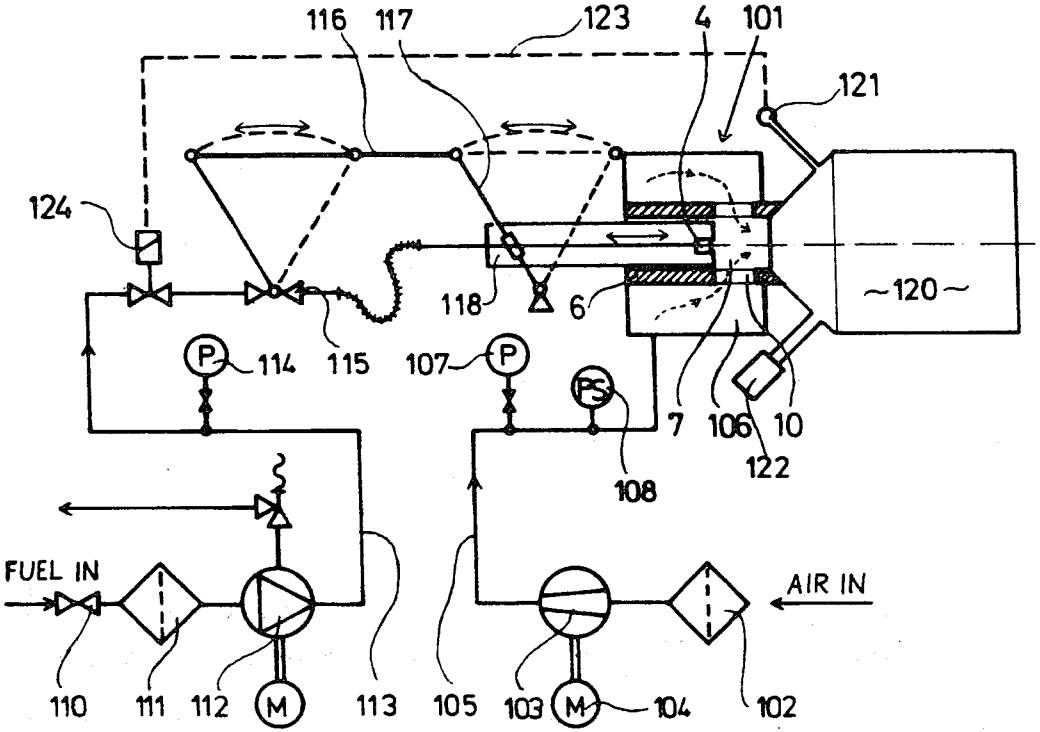
FIG. 1 is a schematical view of a system for controlling a burner assembly by making use of the method according to the present invention.

FIG. 1 shows a control system comprising as the central part thereof a burner assembly 101 serving to burn primarily liquid fuels. A stream of fuel is atomized by means of a nozzle 4 and sprayed into a mixing zone 7 with a droplet size or fuel volume per unit of time depending on the nozzle input pressure. From the side of the fuel stream, combustion air is introduced as an atomizing medium, with the air flow being adapted to be controlled with respect to throughput or flow rate and flow velocity. Initially, the air is aspirated from the atmospheric air through an air filter 102 by means of a blower 103 equipped with a motor 104, and supplied to an air intake duct 106 via a conduit 105. From this duct, the air passes through apertures 10 into said mixing zone 7. A pressure gauge (P) 107 and a pressure switch (PS) 108 are provided for controlling and monitoring the air supply.

The fuel is fed to the burner assembly 101 through a shut-off valve 110, an oil filter 111, an oil pump 112 and via conduit 113. A pressure gauge (P) 114 is used for monitoring the pressure in the conduit. An essential element of the control system is a control valve 115 being mechanically connected, through lever rod 116 including a lever 117, to a movable lance 118 carrying the fuel nozzle 4 at the tip thereof. The lance 118 is movably mounted within an enclosing sleeve 6, namely in such a manner that the tip of the lance to greater or lesser degree covers or closes apertures 10, depending on its position within the shell. By means of such change of the cross-sectional areas of the apertures, the volume or the velocity, respectively, of the combustion/atomizing air entering the mixing chamber is varied. The variation is effected in proportion to the supplied volume of fuel as controlled by the control valve 115.

Light fuel oils are particularly suitable as fuel in view of their high degree of purity. However, it is readily possible, especially if an oil preheating system is used, to employ fuel oils of heavier grades.

Interiorly of the mixing chamber, the oil droplets are broken up further. Then, the resulting fuel/air mixture enters a combustion chamber 120 in which the combustion as such takes place. Ignition is effected by means of an igniting burner including an igniting electrode 122. The system is monitored by means of an UV (ultraviolet) detector 121. In the case of an interruption of the combustion, a magnet or solenoid valve 124 is energized through a control line 123, to interrupt the supply of fuel.

Thus, the control system functions as follows: The power or heat output of the burner assembly is controlled by supplying the volume of fuel required in every instant (control valve 115). By adjustment of valve 115, the movement or advance of the lance 118 is controlled which correspondingly decreases or increases the size of the apertures 10. Hereby, the size or relative opening of the apertures 10 is adjusted such that the combustion air is supplied with a precisely metered volume at any rate. The volume of combustion air is always metered in proportion to the volume of oil supplied. The flow velocity of the introduced combustion air depends on the cross-sectional area of apertures 10. The pressure existing upsteam of the atomizing nozzle 4 and the velocity of the atomizing and combustion air supplied are inversely proportionally related to each other. In addition to controlling the oil flow within the inlet portion, it is also possible to employ spray nozzles in which control is effected in reverse flow fashion.

Nozzles of this type are known per se, and the principle of the invention is not altered by using such nozzles.

Figure 2:
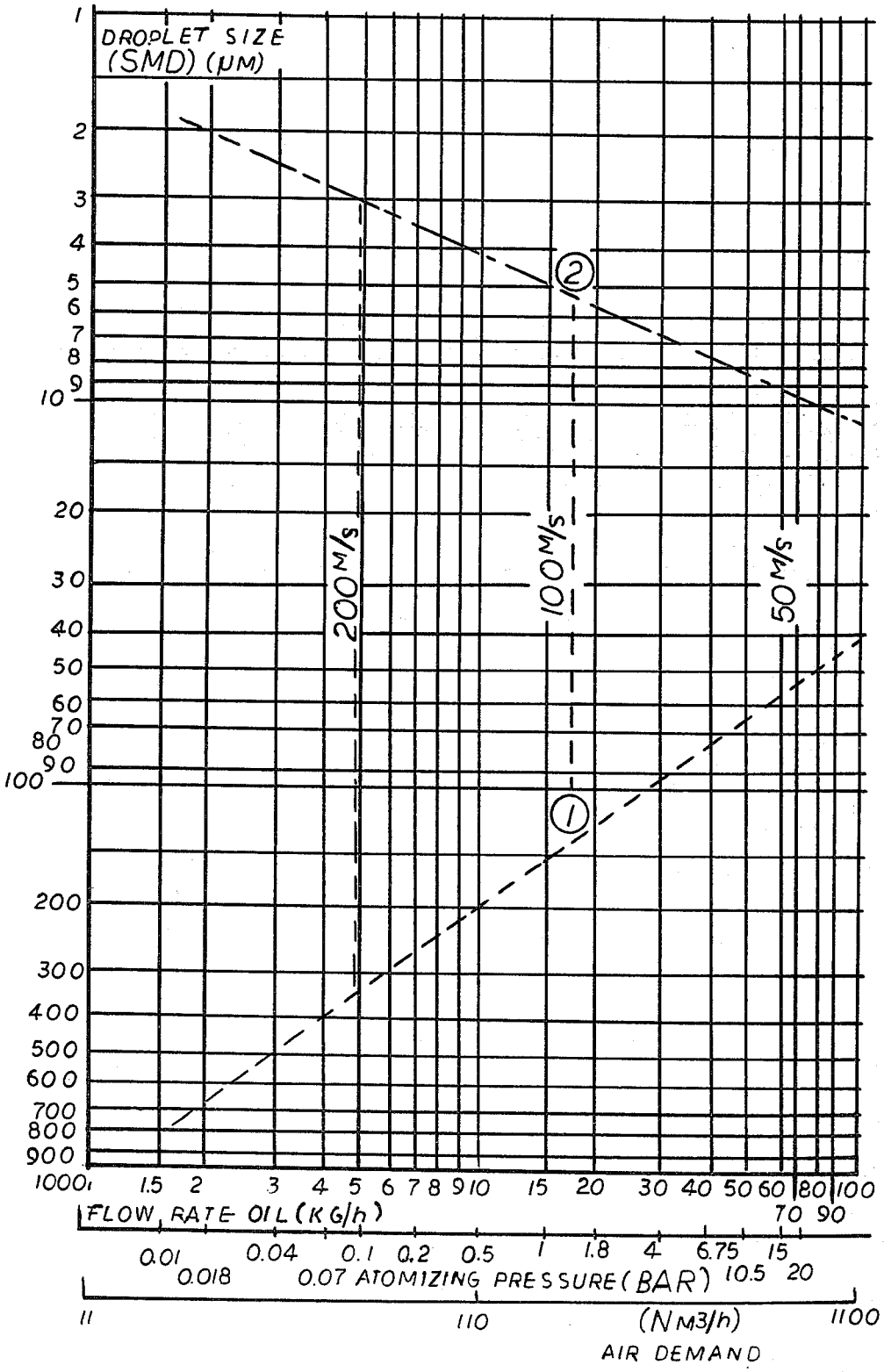
FIG. 2 is a diagram in which various, independent parameters (atomizing pressure; flow rate of oil per hour; air demand) are shown on the abscissa for a specific nozzle, with the droplet size being indicated on the ordinate axis.

The diagram of FIG. 2 illustrates the relations between the most essential parameters. Shown on the abscissa is the atomizing pressure p corresponding to a given flow rate of fuel oil. Further, the abscissa shows the required air demand in terms of combustin air. This ratio is based upon predetermined nozzle dimensions. The data of the diagram have been established by using a commercially available nozzle of the Spraymaster type, Art. No. 113, No. 80 (manufacturer: Fuelmaster, The Hague, Netherlands). The ordinate axis includes the droplet size (SMD) in a curve 1 calculated in accordance with the formula given by SAUTER (1). It is evident that the droplet size increases progressively with lower pressures and correspondingly lower flow rates, until such droplet size becomes "infinitely" high, this state corresponding to a continuous, constantly flowing stream. Initially, these conditions exist under the assumption that laterally introduced atomizing air is not present. By correspondingly controlling the input velocity of the combustion air which by computation (compare formula (2)) is in the range of between about 40 m/sec. and 200 m/sec., owing to the momentum or impulse of the atomizing air impinging the oil droplets, further disintegration of the oil droplets may be obtained, with curve 2 taken as the basis in these respects. In general, it is contemplated to adjust the droplet size to less than 10 $\mu$m in order to obtain substantial blueing of the flame and stoichiometric or reducing combustion. The smaller the mean diameter of the droplets exiting from the nozzle (curve 1), the lower is the required flow velocity of the combustion air supplied. In this connection, it should be taken into consideration that the volume of combustion air is substantially increased with correspondingly higher oil flow rates.

Summarizing, it can be gathered from the diagram of FIG. 2 that it is necessary to empirically determine what air flow velocities are obtained upon entrance of the air into the combustion chamber, in order to efectively reduce the droplet size. In any case, it is not possible to obtain a blue flame or an efficient, stoichiometric combustion, respectively, with droplets having a mean size (diameter) of more than 50 $\mu$m. Hereby, the reduction of the droplets may be effected by using atomizing air which is not supplied under so-called critical pressure conditions, but rather at a pressure of, for example, from 0.3 to 0.1 bar or lower.

FIG. 3 shows a cross-sectional view of a burner assembly of the type that may be used, for instance, in the control system according to FIG. 1. The burner assembly comprises a casing 1 of cylindrical exterior configuration and including a plurality of sections arranged in concentric relation to each other. As seen from the outside to the inside, the casing 1 first encloses a cylindrical air passage 16 which is fed with air through conduit or pipe 105 at a pressure of about 0.1 bar. Arranged in concentric fashion interiorly of the air passage is the lance 118 including the fuel nozzle 4. The lance passes with its mouth 5 into a sleeve 6 which is also of cylindrical shape and the peripheral surface of which is penetrated by two types of apertures 10, 11, namely:

(a) relatively long slots 10 extending across about two-thirds of the length of such sleeve, and (b) comparatively substantially smaller bores or slots 11 opening into a chamber 7' in front of the nozzle orifice.

Sleeve 6, in turn, is connected to an end or cover portion 21 opening with a conically shaped aperture 22 towards a burner tube 23. Preferably, the cover portion 21 forms part of the wall of a boiler or the like.

The elongated lance 118 is provided with a centrally disposed conduit or passage 125. The rear end of the lance protrudes out from casing 1, with the rear end of the lance being provided with a pair of connections, namely an oil pipe cnnection 41 and a gas connection 42. Furthermore, the lance which is movably mounted in casing 1, has mounted to the outer surface thereof a threaded element 43 provided with spiral guiding groove means 44. By rotating a lever 117 in combination with a rotatable bushing 117', the lance is retracted from and projected into casing 6. Hereby, end wall 117" confines the bushing 117' in the axial direction.

Preferably, a liquid fuel is supplied to the inner space of the lance (conduit 125). The fuel conduit terminates in front (upstream) of the atomizing nozzle 4 which is provided with a valve needle. Other conventional atomizing nozzles, even nozzles with reversive control, may be used in the place of the nozzle shown in the drawing; thus, the details of the nozzle need not be explained any further. From the mouth 5 of nozzle 4, the fuel oil enters the mixing zone 7 as divided into moderately fine droplets.

When fuel or heating gas is fired, connection 41 is blocked, and the gas is supplied through conduit 42. In such case, the air is fed in the same manner as in the firing of oil, as will be described immediately below.

FIGS. 4*a* and 4*b* show the foremost portion of the lance within sleeve 6 in various positions. The mixing zone in which the combustion air meets the oil, may be varied in size by varying the position of the lance. In the front portion of the lance, the smaller section of the mixing zone is stationarily disposed as mixing chamber 7' which is continuously fed with combustion air through apertures 11. By retracting the lance 118 from the sleeve, a substantially larger mixing chamber 7" is provided, however, which mixing chamber then is fed with a correspondingly greater volume of combustion air through the slots 10 exposed within the sleeve 6. The volume of the combustion air supplied in lateral direction is substantially greater in the position of FIG. 4*b* as compared to the position of FIG. 4*a;* however, the flow velocity of the combustion air is likewise lower so that the size of the droplets exiting from the nozzle need not be reduced to the same extent as in the position of FIG. 4*a*. In the latter position, the combustion air impinges the droplets with a relatively small volume at high flow velocity, with the droplets having a relatively large size because of the lower pressure P existing in conduit 125. It is even possible to disintegrate (break up) by means of the combustion air a solid stream to such degree that this stream is burnt stoichiometrically in the subsequent combustion chamber. The dashed arrows or the cone shown in broken lines indicate the air paths and the fuel vapor, respectively.

Accordingly, FIG. 4*a* shows the position in the case of low heat demand, while FIG. 4*b* illustrates the position in the case of high heat demand. The flow velocity of the air being higher in the position according to FIG. 4*a* than in that of FIG. 4*b*, results from a plurality of interacting factors. Among such factors, the following may be mentioned: the backpressure produced in the mixing chamber, due to the introduced oil vapor and the stagnating air, decreases with lower load. In the case of conventional fans, the supply pressure increases when the volume of air supplied is reduced.

In the embodiment shown in FIG. 3 and FIGS. 4*a*, 4*b*, control of the air supply is effected by moving the lance 118 which acts to close to higher or lesser degree the air intake apertures 10, 11. These apertures may be formed both by bores and by elongated slots. Preferably, these apertures are distributed around the circumference of the sleeve in axially symmetrical disposition.

The following Figures illustrate other embodiments in which the principle of controlling the air supply has been modified.

FIG. 5 shows a cross-sectional view of a construction wherein a sleeve 6' of the mixing chamber 7 is provided with (circular) bores or holes 12. The outer surface of the sleeve is enclosed by a rotatable shell 13 provided with further bores 13' which open into the air passage 16. By rotating the shell 13 relative to the sleeve 6', the intake cross-sectional area may be varied, whereby the aspired control of air supply may be obtained. In this case, the lance including the fuel nozzle is stationary with respect to the casing. The position of the lance is similar to the position according to FIG. 4*b*.

FIG. 6 illustrates another embodiment wherein the mixing zone 7 is connected to a sleeve 53 connected in turn to the cover portion 21 and including a rotatable inner sleeve or bushing 50. The inner bushing 50 includes bores 51 which, when aligned with corresponding or mating bores 52 of the stationary outer sleeve 53, provide a maximum air flow therethrough; upon rotating the bushing 50 relative to the outer portion, the bores are more and more closed, such that the air supply finally becomes reduced to a minimum amount. In accordance with the inventive principle, rotation of the bushing is effected by means of a drive mechanism 60 acting to rotate bushing 50 by means of a gear. In this way, a varied possibility of influencing (controlling) the fuel stream exiting from the nozzle 4 by the combustion air may be obtained within mixing chamber 7.

Figure 7:
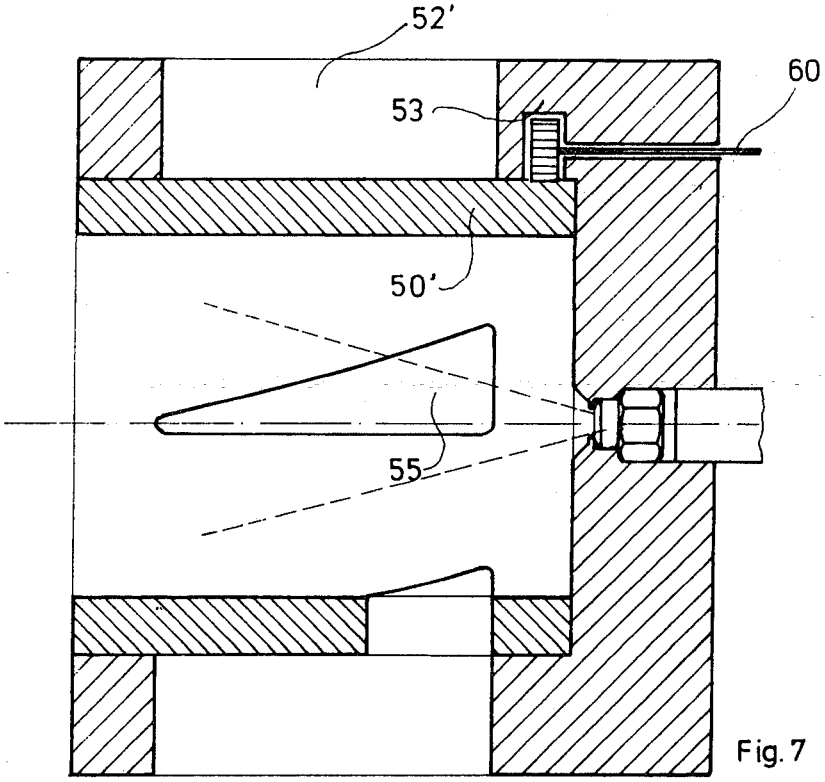

FIG. 7 shows an inner bushing 50' adapted to be rotated by the drive mechanism 60 and provided with triangular slots 55. The outer sleeve 53, on the other hand, is provided with slots 52' of rectangular cross-section. When the inner bushing 50' is rotated, the coinciding cross-section is increasingly opened by the progressive alignment between slots 52' and 55.

Figure 8:
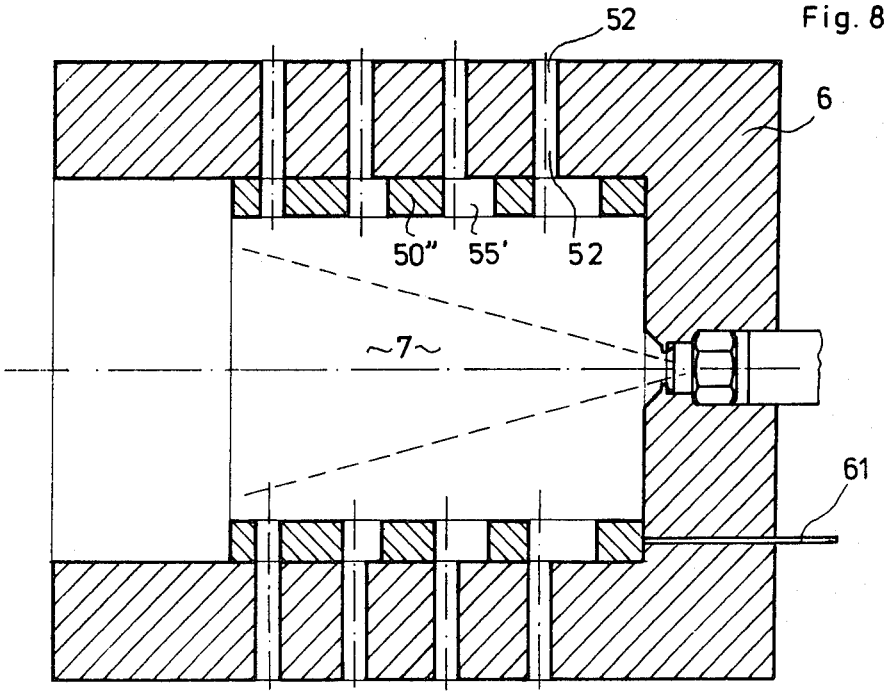

In a reversal of the principle of the movable lance according to FIG. 3, FIG. 8 illustrates the constructional possibility of providing, in the case of a stationary sleeve provided with slots 52, a movable inner bushing 50'' in the region of the wall of mixing chamber 7, which bushing is provided with a plurality of slots 55' of different cross-sectional shapes. When the bushing 50'' is moved by means of a linkage 61, the slots 52 may be exposed in variable manner, whereby the air supply may be controlled.

Figure 9:
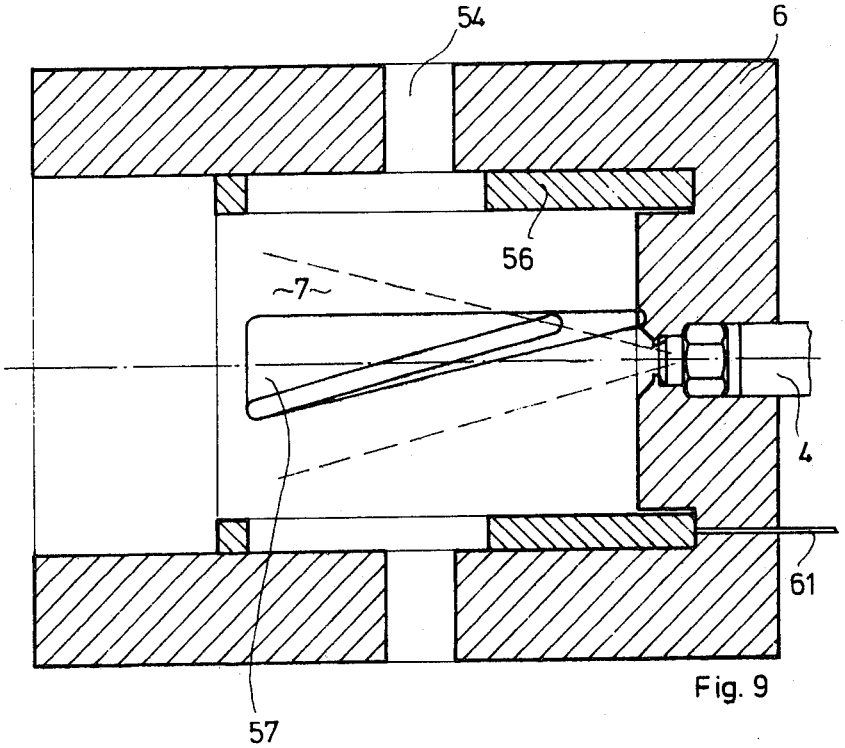

In the embodiment according to FIG. 9, a movable inner bushing or shell 56 is shown within a stationary, outer sleeve 6 provided with bores 54, which shell is provided with triangular slots 57. When the inner shell is moved by means of a linkage 61, these slots more or less open bores 54 leading to the air passage, whereby the air supply is varied.

On the other hand, FIG. 10 illustrates the possibility of providing by means of a movable lance 118, an inner bushing or shell being movable within the sleeve and provided with bores 64 of various cross-sectional configurations. Upon retraction of the lance, the slots of the sleeve are progressively opened. In this way, a multiply stepped mixing chamber 7, 7', 7'' is formed.

According to FIGS. 11*a* and 11*b*, similarly as in FIG. 10, it is contemplated to form the lance 118 so as to be movable. However, the sleeve is not provided with a plurality of rows of holes over the length thereof; rather, the sleeve is penetrated by slots (FIG. 11*b*) of elongated configuration. In specific embodiment, nearly rectangular slots 70', tapering slots 71', triangularly tapering slots 72 and other configurations may be used.

Finally, FIG. 12 illustrates another embodiment wherein great consideration is given to the dual (gas-/oil) applicability of the burner. As mentioned above, the principle of burner technology may be applied also to so-called dual mode burners. In such case, it is required to connect the lance to a gas supply. In order to obtain optimum combustion of gas, it is proposed to provide by-pass channels 42' in the region of nozzle 4, which channels open into the mixing chamber 7 while by-passing the nozzle 4. Regulation of the gas supply is effected by a rotatable perforated disc 41 which, by rotation of the bore 41', progressively opens the channel 42'. The perforated disc 41 is coupled to a rotatable outer shell 18 serving to control the air supply in the oil and gas combustion operations and being drivingly connected to an actuator or servo-motor 26.

The mixing chamber 7 is formed with a conical cross-section having an angle of divergence of about 30°. The gas supply channels 42' open laterally into the conical surfaces, while the fuel nozzle 4 is positioned at the apex of the cone. A rotatable outer shell 18 including a slot provides for a variation of the cross-sectional area of the air supply through sleeve 6 which is likewise provided with bores 11. Rotatable shell 18 is provided with gear teeth 19 formed on the exterior surface thereof and meshing with a gear 24. Gear 24 is connected to a servo-motor 26 through a shaft 25. The servo-motor is fed with its signals, for example, by a central control unit (not shown) acting to control the supply both of oil and of air. Alternatively, a control loop may be provided which controls the supply of oil or air, respectively, in response of the heat demand or of the detected mixture, respectively, or in accordance with the characteristics of the combustion gases, such that optimum and desirable combustion data are always provided.

The dimensions of the burner and of the burner assembly may vary within wide limits. Ordinarily, these dimensions are matched to the conventional and commercially available atomizing nozzles.

Test have shown that the user, when using the embodiment according to FIG. 1, is allowed to burn the atomized oil without soot formation and continuously with a deficiency of air amounting to about 70% of the stoichiometric demand. Furthermore, it is possible to apply a wide range of control for the air supply on the basis of the fuel volumes consumed per hour. As the air pressure within the air passageway is rather low, correspondingly low-power blowers only are required. Expensive pressure blowers need not be installed. In spite of its relatively low momentum, the air entering through bores 10, 11 is successful in effecting further break-up of the oil droplets.

What we claim is:

1. A method of mixing combustion air and liquid fuel for obtaining substantially stoichiometric combustion of the liquid fuel in a burner assembly having a slideable fuel nozzle moveable to vary the size of a fuel and air mixing chamber and a fuel valving means variable over a wide range of fuel flow rates and having a control means for sliding said nozzle and operating said fuel valving means so that the ratio of fuel and air will be substantially constant with changes in the flow rate of fuel flowing in a fuel stream from the nozzle;

said method comprising the steps of:

regulating the flow rate of fuel to said nozzle by the valving means;

introducing a part of the combustion air at the side of the axis of the fuel stream issuing from the fuel nozzle to aid in atomization of the fuel and to maintain fuel particle size in a predetermined range;

operating said control means to slide said fuel nozzle in one direction to change the size of the air inlet opening and to operate said fuel valving means to reduce the fuel flow rate and automatically decreasing the size of the mixing chamber and increasing the velocity of said part of combustion air to provide greater energy for fuel atomization and decreasing the volume of combustion air supplied to the mixing chamber to maintain said ratio of fuel and air; and operating said control means to slide said fuel nozzle in the opposite direction to change the size of the air inlet opening and to operate said fuel valving means to increase the fuel flow rate and automatically increasing the size of said mixing chamber and lowering the velocity of said part of combustion air to provide less energy for fuel atomization and increasing the volume of combustion supplied to the mixing chamber to maintain said ratio of fuel to air.

2. An apparatus for mixing combustion air and liquid fuel for obtaining substantially stoichiometric combustion by maintaining a given ratio of fuel and air in a fuel and air mixing chamber, said apparatus comprising:

a burner assembly having a shell with an air inlet therein for admitting combustion air into a combustion chamber, means for varying the size of said air inlet through said shell comprising a slideable fuel nozzle means in said shell for delivering a fuel stream of liquid fuel to the mixing chamber, said fuel nozzle means being slideable in one direction relative to said shell to reduce the size of the mixing chamber at lower heat demand and being slideable in another direction relative to said shell to increase the size of the mixing chamber at higher heat demand, a fuel control valve means operable to control the flow rate of liquid fuel to said fuel nozzle means, control means for sliding said fuel nozzle means relative to said shell in one direction and for operating therewith said valve means to decrease the fuel flow rate and the size of said mixing chamber and to decrease the size of the combustion air inlet to the mixing chamber and to increase the velocity of the combustion air while decreasing the volume of combustion air thereby maintaining said fuel and air ratio, said control means sliding said fuel nozzle in the opposite direction relative to said shell for operating said valve means to increase the fuel rate and to increase the size of the mixing chamber and to lower the velocity of the combustion air to thereby maintain said fuel to air ratio.

* * * * *